US006244978B1

(12) United States Patent
Higuchi et al.

(10) Patent No.: US 6,244,978 B1
(45) Date of Patent: Jun. 12, 2001

(54) MULTI-PIECE SOLID GOLF BALL

(75) Inventors: Hiroshi Higuchi; Hisashi Yamagishi; Junji Hayashi; Shunichi Kashiwagi; Akira Kawata, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/390,292

(22) Filed: Sep. 3, 1999

(30) Foreign Application Priority Data

Sep. 3, 1998 (JP) ..... 10-249260
Sep. 3, 1998 (JP) ..... 10-249261

(51) Int. Cl.[7] ..... A63B 37/06
(52) U.S. Cl. ..... 473/374; 473/376
(58) Field of Search ..... 473/351, 367, 473/368, 370, 371, 373, 374, 376

(56) References Cited

U.S. PATENT DOCUMENTS 5,253,871 * 10/1993 Viollaz ..... 473/373
5,556,098 * 9/1996 Higuchi et al. ..... 473/373

* cited by examiner

*Primary Examiner*—Mark S. Graham
*Assistant Examiner*—Raeann Gorden
(74) *Attorney, Agent, or Firm*—Sughrue, Mion, Zinn, Macpeak & Seas, PLLC

(57) ABSTRACT

In a multi-piece solid golf ball comprising a solid core, an intermediate layer, and a cover, the intermediate layer is formed mainly of a thermoplastic resin and has a Shore D hardness of 8–35, and the cover is formed of a cover stock comprising a thermoplastic resin and an optional inorganic filler. The cover has a Shore D hardness of 40 to less than 57. The Shore D hardness of the cover is at least 15 units higher than that of the intermediate layer. The ball has a very soft pleasant feel upon approach shots and putting, ease of control upon iron shots, and improved flight performance upon full shots with a driver.

20 Claims, 1 Drawing Sheet

MULTI-PIECE SOLID GOLF BALL

This invention relates to a multi-piece solid golf ball comprising at least three layers, a solid core, an intermediate layer, and a cover.

BACKGROUND OF THE INVENTION

Many two-piece solid golf balls are known in the art. As compared with the wound golf balls, solid golf balls have the advantage of an increased total flight distance on both driver and iron shots, because of a so-called straight line trajectory and a low spin receptivity due to their structure, which allows for a long run. On the other hand, the two-piece solid golf balls are more difficult to control than the wound golf balls in that they do not stop short on the green because of low spin receptivity on iron shots.

Like flight distance, a soft feel when hit is essential for golf balls. The absence of a soft feel represents a substantial loss of commodity value. As compared with the two-piece solid golf balls, wound golf balls have the structural characteristics ensuring a soft and pleasant feel.

For two-piece solid golf balls consisting of a core and a cover, attempts have been made to soften the ball structure in order to accomplish a soft feel upon impact. A soft core is often used to obtain such soft-feel two-piece solid golf balls, but making the core softer lowers the resilience of the golf ball, compromises flight performance, and also markedly reduces durability. As a result, not only do these balls lack the excellent flight performance and durability characteristic of ordinary two-piece solid golf balls, but they are often in fact unfit for actual use.

Various three-piece solid golf balls having a three-layer construction in which an intermediate layer is situated between a solid core and a cover have been proposed to resolve these problems as disclosed, for example, in JP-A 7-24084, 6-23069, 4-244174, 9-10358, and 9-313643.

Golf balls having the cover and the intermediate layer made soft according to these proposals have a soft feel, but a shorter flight distance on full shots with a driver. To insure distance, the cover and the intermediate layer must be formed hard at the sacrifice of the feel upon approach shots and putting. Additionally, the spin performance on iron shots is also exacerbated. None of prior art solid golf balls fully meet the demands. A further improvement is thus desired.

SUMMARY OF THE INVENTION

Therefore, an object of the invention is to provide a multi-piece solid golf ball comprising at least three layers, a solid core, an intermediate layer, and a cover, which has a very soft pleasant feel upon approach shots and putting, ease of control upon iron shots, and improved flight performance upon full shots with a driver.

Regarding a multi-piece solid golf ball comprising at least three layers, a solid core, an intermediate layer, and a cover, the inventor has found that by using a very soft, highly resilient intermediate layer, the multi-piece solid golf ball showing a high spin receptivity and hence, ease of control upon iron shots, and a very soft pleasant feel upon approach shots and putting is obtained at no sacrifice of the flight distance characteristic of ordinary solid golf balls, even when a relatively soft cover is used.

Specifically, the invention in a first aspect provides a multi-piece solid golf ball comprising a solid core, an intermediate layer of at least one layer around the core, and a cover of at least one layer around the intermediate layer, wherein the intermediate layer is formed mainly of a thermoplastic resin having a Shore D hardness of 8 to 35, and the cover is formed mainly of another thermoplastic resin and has a Shore D hardness of 40 to less than 57 which is at least 15 units higher than the Shore D hardness of the intermediate layer.

In a second aspect, the invention provides a multi-piece solid golf ball comprising a solid core, an intermediate layer of at least one layer around the core, and a cover of at least one layer around the intermediate layer, wherein the intermediate layer is formed mainly of a thermoplastic resin having a Shore D hardness of 8 to 35, and the cover is formed of a cover stock comprising another thermoplastic resin as a base component and an inorganic filler and has a Shore D hardness of 40 to less than 57 which is at least 10 units higher than the Shore D hardness of the intermediate layer.

BRIEF DESCRIPTION OF THE DRAWINGS

The only FIGURE.

DESCRIPTION OF THE PREFERRED EMBODIMENTS

Figure 1:
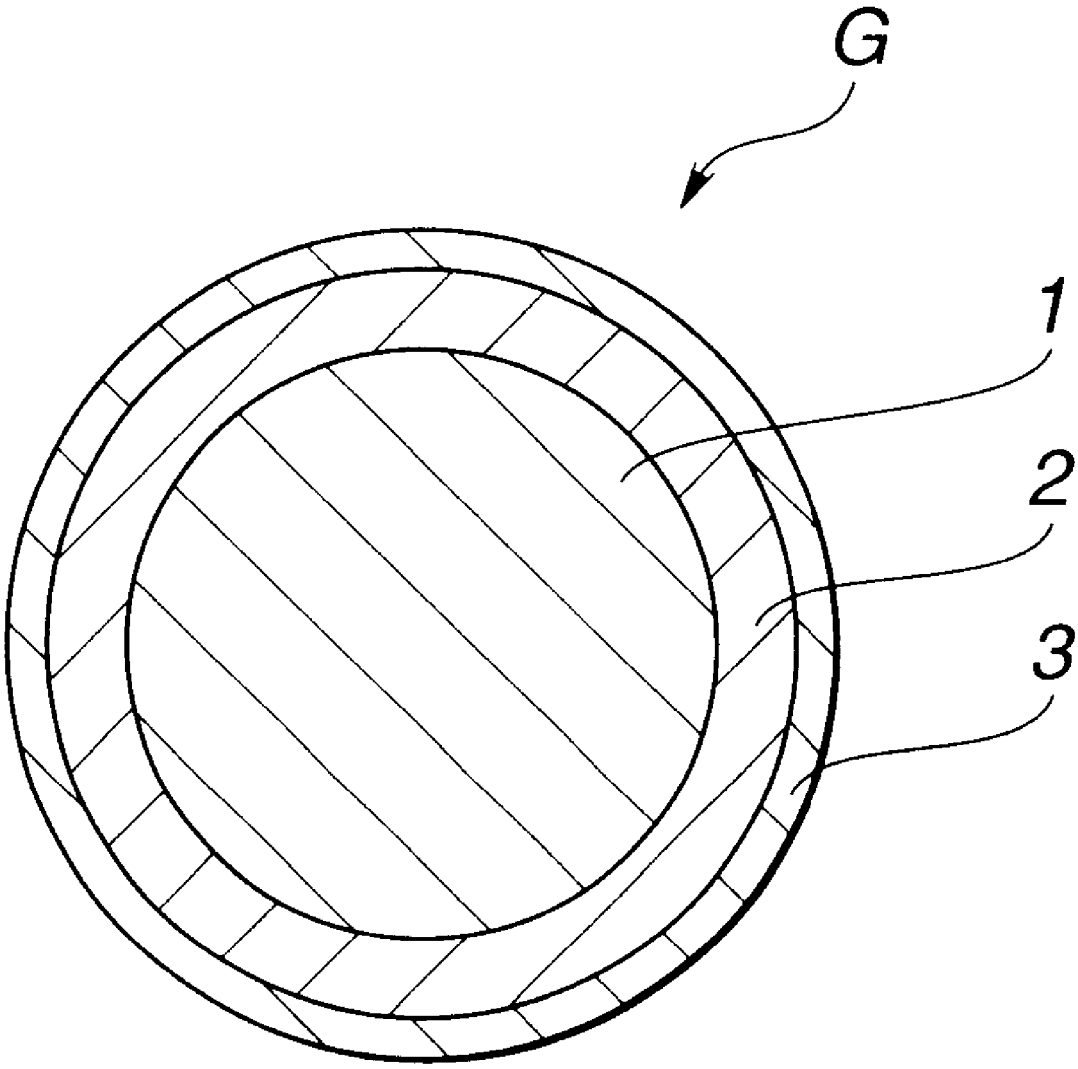
FIG. 1 is a cross-sectional view of a multi-piece solid golf ball according to the preferred embodiment of the invention.

Referring to FIG. 1, a multi-piece solid golf ball G according to the invention is schematically illustrated as comprising a solid core 1, an intermediate layer 2 of at least one layer surrounding the core 1 and a cover 3 of at least one layer surrounding the intermediate layer 2.

The solid core 1 may be formed of a rubber composition primarily comprising a base rubber which is based on polybutadiene rubber, polyisoprene rubber, natural rubber or silicone rubber. Polybutadiene rubber is preferred especially for improved resilience. The preferred polybutadiene rubber is cis-1,4-polybutadiene containing at least 40% cis structure. In the base rubber, another rubber component such as natural rubber, polyisoprene rubber or styrene-butadiene rubber may be blended with the polybutadiene if desired. For high resilience, the other rubber component should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc methacrylate and zinc diacrylate, and esters such as trimethylpropane methacrylate. Of these, zinc diacrylate is preferred because it can impart high resilience. The crosslinking agent is preferably used in an amount of about 15 to 40 parts by weight per 100 parts by weight of the base rubber. A vulcanizing agent such as dicumyl peroxide or a mixture of dicumyl peroxide and 1,1-bis(t-butylperoxy)-3,3,5-trimethylcyclohexane may also be blended in the rubber composition, preferably in an amount of about 0.1 to 5 parts by weight per 100 parts by weight of the base rubber. In the rubber composition, an antioxidant and a specific gravity adjusting filler such as zinc oxide or barium sulfate may be blended. The amount of filler blended is 0 to about 130 parts by weight per 100 parts by weight of the base rubber.

The core-forming rubber composition is obtained by kneading the above-mentioned components in a conventional mixer such as a kneader, Banbury mixer or roll mill. The resulting compound is molded in a mold by injection or compression molding.

In the first embodiment, the solid core preferably has a diameter of 25 to 40 mm, more preferably 27 to 39 mm, and most preferably 30 to 38 mm; a weight of 10 to 40 g, more preferably 15 to 35 g, and most preferably 20 to 32 g; and a specific gravity of 1.1 to 1.5, more preferably 1.12 to 1.45, and most preferably 1.15 to 1.40.

In the second embodiment, the solid core preferably has a diameter of 25 to 40 mm, more preferably 27 to 39 mm, and most preferably 30 to 38 mm; a weight of 10 to 40 g, more preferably 15 to 35 g, and most preferably 20 to 32 g; and a specific gravity of 1.0 to 1.3, more preferably 1.03 to 1.28, and most preferably 1.06 to 1.25.

In the first embodiment where the cover is substantially free of an inorganic filler, the solid core should preferably have a deflection of at least 2.5 mm, more preferably 2.8 to 6.0 mm, further preferably 3.0 to 5.5 mm, and most preferably 3.3 to 5.0 mm, under an applied load of 100 kg. With a core deflection of less than 2.5 mm, the feel of the ball would become hard. With a core deflection of more than 6.0 mm, the resilience would become too low.

In the second embodiment wherein the cover is loaded with an inorganic filler, the solid core should preferably have a deflection of at least 3.0 mm, more preferably 3.2 to 7.0 mm, further preferably 3.4 to 6.5 mm, and most preferably 3.6 to 6.0 mm, under an applied load of 100 kg. With a core deflection of less than 3.0 mm, the feel of the ball would become hard. With a core deflection of more than 7.0 mm, the resilience would become too low.

The core is usually formed to a single layer structure from one material although it may also be formed to a multilayer structure of two or more layers of different materials.

According to the invention, the intermediate layer 2 of at least one layer, preferably one or two layers, is formed around the core 1.

Preferably the intermediate layer is formed mainly of a very soft thermoplastic resin having a Shore D hardness in the range of 8 to 35. By forming between the core and the cover a very soft intermediate layer, which has never been used in the art, a very soft pleasant feel upon approach shots and putting can be accomplished.

As the thermoplastic resin of which the intermediate layer is formed, use may be made of heated mixtures of component (A) a thermoplastic polyester elastomer and component (B) at least one thermoplastic elastomer selected from olefin elastomers, modified olefin elastomers, styrene block copolymers and hydrogenated styrene block copolymers. It is also preferred to use the thermoplastic elastomers component (B) alone.

Of the thermoplastic polyester elastomers component (A), polyether ester type multi-block copolymers are preferred which are synthesized from terephthalic acid, 1,4-butane diol, and polytetramethylene glycol (PTMG) or polypropylene glycol (PPG) so that polybutylene terephthalate (PBT) moieties and polytetramethylene glycol (PTGM) or polypropylene glycol (PPG) moieties may serve as hard and soft segments, respectively. For example, commercially available elastomers such as Hytrel 3078, Hytrel 4047 and Hytrel 4767 from Toray-Dupont K.K. may be used.

With respect to component (B), the olefin elastomers include copolymers of ethylene with alkenes of at least 3 carbon atoms, preferably copolymers of ethylene with alkenes of 3 to 10 carbon atoms, and copolymers of α-olefins with unsaturated carboxylic acid esters or carboxyl or carboxylic anhydride group-bearing polymerizable monomers. Exemplary olefin elastomers are ethylene-propylene copolymer rubber, ethylene-butene copolymer rubber, ethylene-hexene copolymer rubber, and ethylene-octene copolymer rubber. Also included are copolymers obtained by adding to the above components a third component, for example, by adding to ethylene-propylene copolymers a non-conjugated diene such as 5-ethylidene norbornene, 5-methylnorbornene, 5-vinylnorbornene, dicyclopentadiene or butene. Illustrative examples are ethylene-propylene-butene copolymers, ethylene-propylene-butene copolymer rubber, and ethylene-ethyl acrylate copolymer resins. These olefin elastomers are commercially available under the trade name of MITUIEPT and Toughmer from Mitsui Chemical Industry K.K., ENGAGE from Dow Chemical, and Dynaron from Nippon Synthetic Rubber K.K.

Modified products of the above-mentioned olefin elastomers are also useful. Such modified olefin elastomers include ethylene-ethyl acrylate copolymer resins graft modified with maleic anhydride. They are commercially available under the trade name of HPR from Mitsui-Dupont Polychemical K.K.

Component (B) also includes styrene block copolymers, preferably those copolymers having conjugated diene blocks composed of butadiene alone, isoprene alone or a mixture of isoprene and butadiene. Also useful are hydrogenated products of these styrene block copolymers, for example, hydrogenated styrene-butadiene-styrene block copolymers and hydrogenated styrene-isoprene-styrene block copolymers. Such hydrogenated styrene-conjugated diene block copolymers are commercially available under the trade name of Dynaron from Nippon Synthetic Rubber K.K., Septon and Hiblur from Kurare K.K., and Toughtec from Asahi Chemicals Industry K.K.

In the preferred embodiment wherein the intermediate layer is formed of a composition primarily comprising a heated mixture of component (A) a thermoplastic polyester elastomer and component (B) at least one thermoplastic elastomer selected from olefin elastomers, modified olefin elastomers, styrene block copolymers and hydrogenated styrene block copolymers, these components are preferably mixed so that the mixture may contain up to 95% by weight of component (A). That is, the mixture preferably has an (A)/(B) ratio of from 95/5 to 0/100, more preferably from 90/10 to 5/95, most preferably from 80/20 to 10/90, expressed in % by weight. The mixture of components (A) and (B) is commercially available under the trade name of Primalloy from Mitsubishi Chemical K.K.

The intermediate layer may also be formed of a composition primarily comprising the thermoplastic elastomer component (B) selected from olefin elastomers, modified olefin elastomers, styrene block copolymers and hydrogenated styrene block copolymers, alone or mixtures thereof.

In addition to the above-mentioned resin components, the composition of which the intermediate layer is formed may further contain a weight adjusting agent, coloring agent, dispersant, and other additives, if necessary.

Any desired method may be used in forming the intermediate layer around the core. Conventional injection or compression molding may be employed.

The thus molded intermediate layer should have a Shore D hardness in the range of 8 to 35, preferably 9 to 30, more preferably 10 to 29, further preferably 12 to 27, and most preferably 15 to 24. A layer with a Shore D hardness of less than 8 is too soft, less resilient, less durable and unfit for actual use. An intermediate layer with a Shore D hardness of more than 35 is too hard, leading to a hard feel on approach shots and putting and failing to achieve the objects of the invention.

The intermediate layer preferably has a thickness in the range of 0.2 to 5.0 mm, more preferably 0.5 to 4.0 mm, most preferably 0.7 to 3.5 mm, and a specific gravity of at least 0.8, more preferably 0.85 to 1.4, further preferably 0.87 to 1.2, most preferably 0.89 to 1.15.

The cover 3 of at least one layer, preferably one or two layers, is formed around the intermediate layer 2. The cover is formed mainly of a thermoplastic resin which is at least 15 Shore D hardness units harder than the intermediate layer in the first embodiment and at least 10 Shore D hardness units harder than the intermediate layer in the second embodiment.

The cover may be formed mainly of a conventional thermoplastic resin, examples of which include ionomer resins, polyester elastomers, polyamide elastomers, styrene elastomers, polyurethane elastomers, olefin elastomers and mixtures thereof. Of these, the ionomer resins are preferred. Use may be made of commercially available ionomer resins such as "Himilan" from Mitsui-Dupont Polychemical K.K. and "Surlyn" from Dupont. To the cover composition, there may be added UV absorbers, antioxidants and dispersants such as metal soaps, if necessary.

Any desired method may be used in forming the cover around the intermediate layer. Conventional injection or compression molding may be employed.

The thus molded cover preferably has a Shore D hardness of 40 to less than 57, more preferably 45 to 56, further preferably 48 to 55, and most preferably 50 to 54. If the Shore D hardness of the cover is less than 40, the hardness difference from the intermediate layer becomes too small. If the Shore D hardness of the cover is 57 or greater, the hardness difference from the intermediate layer becomes too large. In either case, the objects of the invention are not achievable.

In the first embodiment, the Shore D hardness of the cover should be higher than the Shore D hardness of the intermediate layer by at least 15 units, preferably 15 to 45 units, and more preferably 18 to 40 units. In the second embodiment, the Shore D hardness of the cover should be higher than the Shore D hardness of the intermediate layer by at least 10 units, preferably 10 to 45 units, more preferably 15 to 40 units, and most preferably 20 to 35 units. If the difference in hardness between the cover and the intermediate layer is smaller, the cover would be relatively soft, leading to a reduced resilience. A too much hardness difference would lead to reduced durability, an increased energy loss and a reduced flight distance.

The cover preferably has a thickness in the range of 1.0 to 5.0 mm, more preferably 1.2 to 4.0 mm, further preferably 1.3 to 3.0 mm, most preferably 1.4 to 2.5 mm.

In the second embodiment, an appropriate amount of an inorganic filler is added to the cover stock because the loading of the cover with the inorganic filler can effectively compensate for a loss of durability resulting from the intermediate layer being made very soft. The preferred cover stock contains 100 parts by weight of the resin component and about 5 to 40 parts, more preferably about 15 to 38 parts, most preferably about 18 to 36 parts by weight of the inorganic filler. Less than 5 parts of the filler would provide little reinforcement whereas more than 40 parts of the filler would adversely affect dispersion and resilience.

The inorganic filler blended herein generally has a mean particle size in the range of 0.01 to 100 $\mu$m, preferably 0.1 to 10 $\mu$m, and more preferably 0.1 to 1.0 $\mu$m. Outside the range, larger or smaller filler particles would be difficult to disperse, failing to achieve the objects of the invention. Non-limiting examples of the inorganic filler include barium sulfate, titanium dioxide, calcium carbonate, and tungsten. They may be used alone or in admixture of two or more. Barium sulfate and titanium dioxide are most preferable.

The cover stock loaded with the inorganic filler should preferably have a specific gravity of at least 1.0, more preferably 1.01 to 1.4, further preferably 1.05 to 1.3, most preferably 1.1 to 1.2.

An appropriate amount of an inorganic filler may also be added to the intermediate layer. By adding the inorganic fillers to both the cover and the intermediate layer, a further improvement in durability is made. Preferably about 5 to 40 parts, more preferably about 15 to 38 parts by weight of the inorganic filler is added to 100 parts by weight of the resin component of which the intermediate layer is formed. The type, mean particle size and other parameters of the inorganic filler are the same as described for the cover.

There has been described a multi-piece solid golf ball comprising a relatively soft core, a very soft intermediate layer enclosing the core, and a relatively hard cover enclosing the intermediate layer, wherein an appropriate amount of inorganic filler is preferably added to the cover and optionally the intermediate layer. Owing to these features combined, the ball has a very soft pleasant feel upon approach shots and putting, a high spin receptivity and hence, ease of control upon iron shots, improved durability against consecutive strikes, and improved flight performance upon full shots with a driver.

The golf ball of the invention is provided on its surface with a multiplicity of dimples. Typically the ball surface is subject to various finish treatments including stamping and paint coating. The ball as a whole preferably has a deflection under an applied load of 100 kg in the range of 2.8 to 6.0 mm, more preferably 3.1 to 5.5 mm. The golf ball must have a diameter of not less than 42.67 mm and a weight of not greater than 45.93 grams in accordance with the Rules of Golf. Preferably the ball has a weight of 44.5 to 45.8 grams, more preferably 44.9 to 45.7 grams, and most preferably 45.2 to 45.6 grams.

EXAMPLE

Examples of the invention are given below by way of illustration and not by way of limitation. The amounts of ingredients in Tables are parts by weight.

Examples 1–7 & Comparative Examples 1–6

Core-forming rubber compositions of the formulation shown in Table 1 were mixed in a kneader and molded and vulcanized in a core mold at a temperature of 155° C. for about 15 minutes, forming solid cores.

Around the cores, the intermediate layer and cover were formed by injection molding the intermediate layer compositions of the formulation shown in Table 2 and the cover compositions of the formulation shown in Table 3, respectively. Three-piece solid golf balls in Examples 1–7 and Comparative Examples 1, 2, 4 and 5 were obtained.

The three-piece ball of Comparative Example 3 was prepared by preforming a pair of half shells from the intermediate layer composition of the formulation shown in Table 2, encasing the core within the half shells, vulcanizing the assembly in a mold at 155° C. for 15 minutes to form a dual solid core, and injection molding the cover composition around the dual solid core. Comparative Example 6 was a two-piece golf ball consisting of the core and the cover without the intermediate layer.

The golf balls were examined for several properties by the following tests. The results are shown in Tables 4 and 5.

Solid Core Deflection

The deflection (mm) of the solid core under an applied load of 100 kg was measured.

Flight performance

A swing robot (by Miyamae K.K.) was equipped with a driver (W#1, PRO 230 Titan, loft angle 10°, by Bridgestone Sports Co., Ltd.). The ball was struck with the driver at a head speed of 45 m/sec (HS 45), and the carry, total distance, and spin rate were measured. The club was changed to No. 9 iron (I#9, Model 55-HM, loft angle 44°, by Bridgestone Sports Co., Ltd.). The ball was struck with the iron at a head speed of 33 m/sec (HS 33), and the spin rate was measured.

Feel

Five professional golfers actually hit the ball with the driver (W#1), No. 9 iron (I#9), and putter (PT) and evaluated according to the following criterion.

VS: very soft

Av: ordinary

Hard: hard

Durability

Using a swing robot (by Miyamae K.K.), the ball was repeatedly struck with a driver (PRO 230 Titan, loft angle 10°, Bridgestone Sports Co., Ltd.) at a head speed of 45 m/sec. The surface state of the ball was evaluated relative to the number of strikes and rated according to the following criterion.

OK: no problem

W: relatively premature breakage

VW: premature breakage

TABLE 1

| | Example | | | | | | | Comparative Example | | | | | |
|---|---|---|---|---|---|---|---|---|---|---|---|---|---|
| | 1 | 2 | 3 | 4 | 5 | 6 | 7 | 1 | 2 | 3 | 4 | 5 | 6 |
| Polybutadiene* | 100 | 100 | 100 | 100 | 100 | 100 | 100 | 100 | 100 | 100 | 100 | 100 | 100 |
| Zinc diacrylate | 26 | 24 | 22 | 29 | 29 | 35 | 24 | 33 | 33 | 38 | 34 | 34 | 23.5 |
| Dicumyl peroxide | 1 | 1 | 1 | 1 | 1 | 1 | 1 | 1 | 1 | 1 | 1 | 1 | 1 |
| Antioxidant | 0.1 | 0.1 | 0.1 | 0.1 | 0.1 | 0.1 | 0.1 | 0.1 | 0.1 | 0.1 | 0.1 | 0.1 | 0.1 |
| Barium sulfate | 33 | 27.8 | 20.8 | 22.6 | 36.5 | 43 | 23.9 | 17 | 19 | 20.4 | 12.6 | 20.3 | 18 |
| Zinc oxide | 5 | 5 | 5 | 5 | 5 | 5 | 5 | 5 | 5 | 5 | 5 | 5 | 5 |
| Zinc salt of pentachlorothiophenol | 1 | 1 | 1 | 1 | 1 | 1 | 1 | 1 | 1 | 1 | 1 | 1 | 1 |

*BR01 by Nippon Synthetic Rubber K.K.

TABLE 2

| | a | b | c | d | e | f | g | h | i |
|---|---|---|---|---|---|---|---|---|---|
| Hytrel 3078 | — | 25 | — | 82 | 90 | — | — | — | — |
| Hytrel 4047 | — | — | — | — | — | 100 | — | — | — |
| PEBAX 3533 | — | — | — | — | — | — | 100 | — | — |
| Primalloy A1500 | — | 75 | 100 | — | 10 | — | — | — | — |
| HPR AR 201 | — | — | — | 18 | — | — | — | — | — |
| Toughtec M1943 | 100 | — | — | — | — | — | — | — | — |
| Himilan 1706 | — | — | — | — | — | — | — | — | 60 |
| Surlyn 8120 | — | — | — | — | — | — | — | — | 40 |
| Barium sulfate | — | — | — | — | — | — | — | — | 5.6 |
| Polybutadiene | — | — | — | — | — | — | — | 100 | — |
| Zinc diacrylate | — | — | — | — | — | — | — | 34 | — |
| Dicumyl peroxide | — | — | — | — | — | — | — | 1 | — |
| Antioxidant | — | — | — | — | — | — | — | 0.1 | — |
| Barium sulfate | — | — | — | — | — | — | — | 6.4 | — |
| Zinc oxide | — | — | — | — | — | — | — | 5 | — |
| Zinc salt of pentachlorothiophenol | — | — | — | — | — | — | — | 1 | — |

Note: Hytrel is the trade name of polyester elastomers by Toray-Dupont K.K.
PEBAX is the trade name of polyamide elastomers by Atochem.
Primalloy is the trade name of polyester elastomer base polymer alloys by Mitsubishi Chemical Industry K.K.
HPR AR 201 is the trade name of maleic anhydride-graft-modified ethylene-ethyl acrylate copolymer resins by Mitsui-Dupont K.K.
Toughtec is the trade name of styrene elastomers by Asahi Chemicals K.K.
Himilan is the trade name of ionomer resins by Mitsui-Dupont Polychemical K.K.
Surlyn is the trade name of ionomer resins by Dupont.

TABLE 3

| | A | B | C | D | E | F | G | H |
|---|---|---|---|---|---|---|---|---|
| Himilan 1601 | 18 | 37 | 11 | — | — | — | — | — |
| Himilan 1557 | 18 | 37 | 11 | — | — | — | — | — |
| Himilan 1605 | — | — | — | 28 | 50 | — | — | — |
| Himilan 1706 | — | — | — | 28 | 50 | — | 45 | 70 |
| Surlyn 8120 | 64 | 26 | 78 | 44 | — | 100 | 55 | 30 |
| Titanium dioxide | 5.6 | 5.6 | 5.6 | 5.6 | 5.6 | 5.6 | 5.6 | 5.6 |

Note: Himilan is the trade name of ionomer resins by Mitsui-Dupont Polychemical K.K.
Surlyn is the trade name of ionomer resins by Dupont.

TABLE 4

| | | | Example | | | | | | |
|---|---|---|---|---|---|---|---|---|---|
| | | | 1 | 2 | 3 | 4 | 5 | 6 | 7 |
| Core | Weight (g) | | 28.7 | 27.9 | 33.6 | 27.5 | 23.2 | 22.1 | 27.4 |
| | Outer diameter (mm) | | 35.2 | 35.2 | 37.9 | 35.2 | 32.6 | 31.7 | 35.2 |
| | Deflection (mm) | | 4.0 | 4.4 | 4.8 | 3.6 | 3.6 | 2.8 | 4.4 |
| | Specific gravity | | 1.255 | 1.223 | 1.180 | 1.206 | 1.279 | 1.322 | 1.202 |
| Intermediate layer | Type | | a | b | c | d | b | c | e |
| | Shore D hardness A | | 25 | 20 | 17 | 27 | 20 | 17 | 29 |
| | Weight* (g) | | 35.2 | 35.2 | 37.8 | 35.2 | 35.2 | 37.8 | 35.2 |
| | Outer diameter* (mm) | | 38.6 | 38.6 | 39.7 | 38.6 | 38.6 | 39.7 | 38.6 |
| | Specific gravity | | 0.90 | 1.00 | 0.98 | 1.06 | 1.00 | 0.98 | 1.07 |
| | Gage (mm) | | 1.70 | 1.70 | 0.90 | 1.70 | 3.00 | 4.00 | 1.70 |
| Cover | Type | | A | B | A | C | D | B | A |
| | Specific gravity | | 0.98 | 0.98 | 0.98 | 0.98 | 0.98 | 0.98 | 0.98 |
| | Gage (mm) | | 2.05 | 2.05 | 1.50 | 2.05 | 2.05 | 1.50 | 2.05 |
| | Shore D hardness B | | 50 | 55 | 50 | 48 | 55 | 55 | 50 |
| Hardness difference (B-A) | | | 25 | 35 | 33 | 21 | 35 | 38 | 21 |
| Ball | Weight (g) | | 45.3 | 45.3 | 45.3 | 45.3 | 45.3 | 45.3 | 45.3 |
| | Diameter (mm) | | 42.7 | 42.7 | 42.7 | 42.7 | 42.7 | 42.7 | 42.7 |
| Flight performance | W#1/HS45 | Carry (m) | 208.2 | 208.5 | 208.2 | 209.2 | 209.5 | 209.6 | 208.9 |
| | | Total (m) | 221.5 | 222.7 | 223.0 | 222.6 | 223.0 | 223.2 | 222.8 |
| | | Spin (rpm) | 2720 | 2638 | 2703 | 2811 | 2732 | 2853 | 2645 |
| | I#9 | Spin (rpm) | 9211 | 9136 | 9228 | 9532 | 9251 | 9352 | 9158 |
| Feel | W#1 | | VS | VS | VS | VS | VS | VS | VS |
| | I#9 | | VS | VS | VS | VS | VS | VS | VS |
| | PT | | VS | VS | VS | VS | VS | VS | VS |
| Durability | | | OK | OK | OK | OK | OK | OK | OK |

*core + intermediate layer

TABLE 5

| | | | Example | | | | | |
|---|---|---|---|---|---|---|---|---|
| | | | 1 | 2 | 3 | 4 | 5 | 6 |
| Core | Weight (g) | | 27.1 | 30.2 | 16.7 | 29.6 | 30.7 | 35.5 |
| | Outer diameter (mm) | | 35.2 | 36.4 | 29.7 | 36.5 | 36.5 | 38.7 |
| | Deflection (mm) | | 3.0 | 3.0 | 2.3 | 2.9 | 2.9 | 4.5 |
| | Specific gravity | | 1.185 | 1.196 | 1.214 | 1.164 | 1.204 | 1.168 |
| Intermediate layer | Type | | f | g | h | f | i | — |
| | Shore D hardness A | | 40 | 42 | 55 | 40 | 56 | — |
| | Weight* (g) | | 35.2 | 38.6 | 35.5 | 37.8 | 37.8 | — |
| | Outer diameter* (mm) | | 38.6 | 40.0 | 38.7 | 39.7 | 39.7 | — |
| | Specific gravity | | 1.12 | 1.01 | 1.13 | 1.12 | 0.98 | — |
| | Gage (mm) | | 1.70 | 1.80 | 4.50 | 1.60 | 1.60 | — |
| Cover | Type | | E | F | E | G | H | E |
| | Specific gravity | | 0.98 | 0.98 | 0.98 | 0.98 | 0.98 | 0.98 |
| | Gage (mm) | | 2.05 | 1.35 | 2.00 | 1.50 | 1.50 | 2.00 |
| | Shore D hardness B | | 63 | 45 | 63 | 53 | 58 | 63 |
| Hardness difference (B-A) | | | 23 | 3 | 8 | 13 | 2 | — |
| Ball | Weight (g) | | 45.3 | 45.3 | 45.3 | 45.3 | 45.3 | 45.3 |
| | Diameter (mm) | | 42.7 | 42.7 | 42.7 | 42.7 | 42.7 | 42.7 |
| Flight performance | W#1/HS45 | Carry (m) | 207.9 | 205.3 | 204.9 | 205.8 | 207.9 | 204.2 |
| | | Total (m) | 221.0 | 217.5 | 217.3 | 218.1 | 219.2 | 218.5 |
| | | Spin (rpm) | 2548 | 3001 | 2657 | 2898 | 2689 | 2480 |
| | I#9 | Spin (rpm) | 8335 | 9343 | 8453 | 8935 | 8566 | 7786 |
| Feel | W#1 | | VS | Av | Hard | Hard | Hard | VS |
| | I#9 | | Av | Av | Hard | VS | VS | Av |
| | PT | | Hard | Av | Hard | VS | Av | Av |
| Durability | | | OK | OK | OK | OK | OK | VW |

*core + intermediate layer

As seen from the results of Tables 4 and 5, the balls of Comparative Examples 1 to 5 fail to accomplish the effect and performance of the invention. This is because the balls of Comparative Examples 1 to 5 have an intermediate layer Shore D hardness of at least 40, the cover in Comparative Examples 1 and 3 has a high Shore D hardness of 63, the cover in Comparative Example 5 has a Shore D hardness of 58, and the hardness difference between the cover and the intermediate layer in Comparative Examples 2 to 5 is less than 15 Shore D units. More particularly, Comparative Example 1, which is a three-piece ball of the same type as JP-A 7-24084, travels a relatively long distance on driver shots, but shows a poor spin receptivity when hit with No. 9 iron and a hard unpleasant feel when hit with the putter. Comparative Example 2, which is a three-piece ball of the same type as JP-A 4-244174, travels a relatively short distance on full shots with the driver. Comparative Example 3, which is a three-piece ball of the same type as JP-A 6-23069, travels a relatively short distance on full shots with the driver and shows a poor spin receptivity when hit with No. 9 iron and a hard unpleasant feel when hit with any of the driver, No. 9 iron and putter. Comparative Example 4, which is a three-piece ball of the same type as JP-A 9-10358, travels a relatively short distance on full shots with the driver and shows a hard unpleasant feel when hit. Comparative Example 5, which is a three-piece ball of the same type as JP-A 9-313643, travels a relatively long distance on full shots with the driver, but has a hard unpleasant feel when hit with the driver. Comparative Example 6, which is a soft type two-piece solid golf ball, travels a short distance on full shots with the driver and shows a very poor spin receptivity when hit with No. 9 iron, and its durability against consecutive strikes is very low.

In contrast, the three-piece balls of Examples 1 to 7 have a very soft pleasant feel when hit with any of the driver, No. 9 iron and putter, a high spin receptivity when hit with No. 9 iron, and a drastically increased flight distance upon full shots with the driver.

Examples 8–13

Core-forming rubber compositions of the formulation shown in Table 6 were mixed in a kneader and molded and vulcanized in a core mold at a temperature of 155° C. for about 15 minutes, forming solid cores.

Around the cores, the intermediate layer and cover were formed by injection molding the intermediate layer compositions of the formulation shown in Table 7 and the cover compositions of the formulation shown in Table 8, respectively. Three-piece solid golf balls in Examples 8–13 were obtained.

The golf balls were examined for several properties by the same tests as in Example 1. The results are shown in Table 9.

TABLE 6

| | Example | | | | | |
|---|---|---|---|---|---|---|
| | 8 | 9 | 10 | 11 | 12 | 13 |
| Polybutadiene* | 100 | 100 | 100 | 100 | 100 | 100 |
| Zinc diacrylate | 22 | 20 | 20 | 19 | 22 | 21 |
| Dicumyl peroxide | 1 | 1 | 1 | 1 | 1 | 1 |
| Antioxidant | 0.1 | 0.1 | 0.1 | 0.1 | 0.1 | 0.1 |
| Barium sulfate | 14.4 | 12.8 | 12.1 | 21.6 | 7.7 | 5 |
| Zinc oxide | 5 | 5 | 5 | 5 | 5 | 5 |

TABLE 6-continued

| | Example | | | | | |
|---|---|---|---|---|---|---|
| | 8 | 9 | 10 | 11 | 12 | 13 |
| Zinc salt of pentachlorothiophenol | 1 | 1 | 1 | 1 | 1 | 1 |

*BR01 by Nippon Synthetic Rubber K.K.

TABLE 7

| | a | b | c | d | e | f |
|---|---|---|---|---|---|---|
| Hytrel 3078 | — | 75 | 40 | 82 | 10 | 40 |
| Primalloy A1500 | 100 | — | — | — | 90 | 60 |
| HPR AR 201 | — | — | 60 | 18 | — | — |
| Toughtec M1943 | — | 25 | — | — | — | — |
| Barium sulfate | — | — | — | — | 30 | — |
| Tungsten | — | — | — | — | — | 15 |

Note:
Hytrel is the trade name of polyester elastomers by Toray-Dupont K.K.
Primalloy is the trade name of polyester elastomer base polymer alloys by Mitsubishi Chemical Industry K.K.
HPR AR 201 is the trade name of maleic anhydride-graft-modified ethylene-ethyl acrylate copolymer resins by Mitsui-Dupont K.K.
Toughtec is the trade name of styrene elastomers by Asahi Chemicals K.K.

Primalloy is the trade name of polyester elastomer base polymer alloys by Mitsubishi Chemical Industry K.K. HPR AR 201 is the trade name of maleic anhydride-graft-modified ethylene-ethyl acrylate copolymer resins by Mitsui-Dupont K.K. Toughtec is the trade name of styrene elastomers by Asahi Chemicals K.K.

TABLE 8

| | A | B | C | D | E |
|---|---|---|---|---|---|
| Himilan 1601 | — | 18 | 37 | — | 30 |
| Himilan 1557 | — | 18 | 37 | — | 30 |
| Himilan 1605 | 25 | — | — | 25 | — |
| Himilan 1706 | 25 | — | — | 25 | — |
| Surlyn 8120 | 50 | 64 | 26 | 50 | 40 |
| Titanium dioxide | 5.6 | 5.6 | 5.6 | 5.6 | 5.6 |
| Barium sulfate | 28 | 28 | 17 | 17 | 28 |

Note:
Himilan is the trade name of ionomer resins by Mitsui-Dupont Polychemical K.K.
Surlyn is the trade name of ionomer resins by Dupont.

TABLE 9

| | | Example | | | | | |
|---|---|---|---|---|---|---|---|
| | | 8 | 9 | 10 | 11 | 12 | 13 |
| Core | Weight (g) | 26.1 | 25.8 | 32.1 | 21.4 | 25.2 | 24.8 |
| | Outer diameter (mm) | 35.2 | 35.2 | 37.9 | 32.6 | 35.2 | 35.2 |
| | Deflection (mm) | 4.8 | 5.2 | 5.2 | 5.4 | 4.8 | 5.0 |
| | Specific gravity | 1.144 | 1.129 | 1.125 | 1.177 | 1.105 | 1.086 |
| Intermediate layer | Type | a | b | c | d | e | f |
| | Shore D hardness A | 17 | 29 | 20 | 27 | 20 | 23 |
| | Weight* (g) | 33.3 | 33.3 | 36.4 | 34.0 | 34.0 | 33.3 |

TABLE 9-continued

| | | | Example | | | | | |
|---|---|---|---|---|---|---|---|---|
| | | | 8 | 9 | 10 | 11 | 12 | 13 |
| | Outer diameter* (mm) | | 38.6 | 38.6 | 39.7 | 38.6 | 38.6 | 38.6 |
| | Specific gravity | | 0.98 | 1.03 | 1.00 | 1.06 | 1.20 | 1.16 |
| | Gage (mm) | | 1.70 | 1.70 | 0.90 | 3.00 | 1.70 | 1.70 |
| Cover | Type | | A | A | B | C | D | E |
| | Specific gravity | | 1.17 | 1.17 | 1.17 | 1.10 | 1.10 | 1.17 |
| | Gage (mm) | | 2.05 | 2.05 | 1.50 | 2.05 | 2.05 | 2.05 |
| | Shore D hardness B | | 56 | 56 | 52 | 56 | 55 | 55 |
| Hardness difference (B-A) | | | 39 | 27 | 32 | 29 | 35 | 32 |
| Ball | Weight (g) | | 45.3 | 45.3 | 45.3 | 45.3 | 45.3 | 45.3 |
| | Diameter (mm) | | 42.7 | 42.7 | 42.7 | 42.7 | 42.7 | 42.7 |
| Flight performance | W#1/HS45 | Carry (m) | 208.4 | 208.6 | 208.2 | 209.2 | 209.5 | 208.9 |
| | | Total (m) | 222.1 | 222.7 | 223.0 | 222.6 | 223.0 | 222.8 |
| | | Spin (rpm) | 2693 | 2501 | 2678 | 2518 | 2695 | 2625 |
| | I#9 | Spin (rpm) | 9212 | 9192 | 9326 | 9211 | 9251 | 9201 |
| Feel | W#1 | | VS | VS | VS | VS | VS | VS |
| | I#9 | | VS | VS | VS | VS | VS | VS |
| | PT | | VS | VS | VS | VS | VS | VS |
| Durability | | | OK | OK | OK | OK | OK | OK |

*core + intermediate layer

The three-piece balls of Examples 8 to 13 have a very soft pleasant feel when hit with any of the driver, No. 9 iron and putter, a high spin receptivity when hit with No. 9 iron, and a drastically increased flight distance upon full shots with the driver.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A multi-piece solid golf ball comprising; a solid core formed of a rubber composition, an intermediate layer of at least one layer around the core, and a cover of at least one layer around the intermediate layer, said intermediate layer formed mainly of a thermoplastic resin having a Shore D hardness in the range of 8 to 29 and, said cover formed mainly of another thermoplastic resin and has a Shore D hardness in the range of 40 to 55 and which is at least 15 units higher than the Shore D hardness of said intermediate layer.

2. The multi-piece solid golf ball of claim 1 wherein said solid core is formed mainly of a rubber base and has a specific gravity in the range of of 1.1 to 1.5 and a deflection of at least 2.5 mm under an applied load of 100 kg.

3. The multi-piece solid golf ball of claim 1 wherein said intermediate layer is formed mainly of a heated mixture of (A) a thermoplastic polyester elastomer and (B) at least one thermoplastic elastomer selected from the group consisting of olefin elastomers, modified olefin elastomers, styrene block copolymers and hydrogenated styrene block copolymers, or the thermoplastic elastomer defined as (B).

4. The multi-piece solid golf ball of claim 1 wherein said intermediate layer has a thickness in the range of 0.2 to 5.0 mm.

5. The multi-piece solid golf ball of claim 1 wherein said cover is formed mainly of an ionomer resin and has a thickness in the range of 1.0 to 5.0 mm.

6. A multi-piece solid golf ball comprising; a solid core formed of a rubber composition, an intermediate layer of at least one layer around the core, and a cover of at least one layer around the intermediate layer, said intermediate layer formed mainly of a thermoplastic resin having a Shore D hardness of 8 to 35, and said cover formed of a cover stock comprising 100 parts by weight of another thermoplastic resin as a base component and 15 to 40 parts by weight of an inorganic filler and has a Shore D hardness of 40 to less than 57 which is at least 10 units higher than the Shore D hardness of said intermediate layer.

7. The multi-piece solid golf ball of claim 6 wherein said solid core is formed mainly of a rubber base and has a specific gravity in the range of 1.0 to 1.3 and a deflection of at least 3.0 mm under an applied load of 100 kg.

8. The multi-piece solid golf ball of claim 6 wherein said intermediate layer is formed mainly of a heated mixture of (A) a thermoplastic polyester elastomer and (B) at least one thermoplastic elastomer selected from the group consisting of olefin elastomers, modified olefin elastomers, styrene block copolymers and hydrogenated styrene block copolymers, or the thermoplastic elastomer defined as (B).

9. The multi-piece solid golf ball of claim 6 wherein said intermediate layer has a thickness in the range of 0.2 to 5.0 mm and a specific gravity of at least 0.8.

10. The multi-piece solid golf ball of claim 6 wherein said cover is formed mainly of an ionomer resin and has a thickness in the range of 1.0 to 5.0 mm and a specific gravity of at least 1.0.

11. The multi-piece solid golf ball of claim 1, wherein the intermediate layer has a Shore D hardness in the range of 8 to 24.

12. The multi-piece solid golf ball of claim 3, wherein the mixture of intermediate layer has a (A)/(B) ratio of 95/5 to 0/100.

13. The multi-piece solid golf ball of claim 6, wherein the thermoplastic resin of the intermediate layer has a Shore D hardness in the range of 8 to 29.

14. The multi-piece solid golf ball of claim 6, wherein the thermoplastic resin of the intermediate layer has a Shore D hardness in the range of 8 to 24.

15. The multi-piece solid golf ball of claim 8, wherein the mixture of the intermediate layer has a (A)/(B) ratio of 95/5 to 0/100.

16. The multi-piece solid golf ball of claim 6, wherein the inorganic filler comprises one or more selected from barium sulfate, titanium dioxide, calcium carbonate, and tungsten.

17. The multi-piece solid golf ball of claim 6, wherein the cover comprises barium sulfate and titanium dioxide as the inorganic filler.

18. The multi-piece solid golf ball of claim 6, wherein the inorganic filler has a means particle size in the range of 0.01 to 100 $\mu$m.

19. The multi-piece golf ball of claim 1, wherein the Shore D hardness of said cover is in the range of 18 to 40 units greater than the Shore D hardness of said intermediate layer.

20. The multi-piece golf ball of claim 6, wherein the Shore D hardness of said cover is in the range of 20 to 35 units higher than the Shore D hardness of said intermediate layer.

* * * * *